US011423772B2

(12) United States Patent
Takenaka et al.

(10) Patent No.: US 11,423,772 B2
(45) Date of Patent: Aug. 23, 2022

(54) ANOMALY DETECTOR, ANOMALY DETECTION PROGRAM, ANOMALY DETECTION METHOD, ANOMALY DETECTION SYSTEM, AND IN-VEHICLE DEVICE

(71) Applicant: DENSO CORPORATION, Kariya (JP)

(72) Inventors: Kazuhito Takenaka, Kariya (JP); Hideaki Misawa, Kariya (JP); Daisuke Hirano, Kariya (JP)

(73) Assignee: DENSO CORPORATION, Kariya (JP)

( * ) Notice: Subject to any disclaimer, the term of this patent is extended or adjusted under 35 U.S.C. 154(b) by 88 days.

(21) Appl. No.: 16/742,107

(22) Filed: Jan. 14, 2020

(65) Prior Publication Data

US 2020/0226920 A1 Jul. 16, 2020

(30) Foreign Application Priority Data

Jan. 16, 2019 (JP) ..... JP2019-005542

(51) Int. Cl.
*G08G 1/01* (2006.01)

(52) U.S. Cl.
CPC ..... *G08G 1/0129* (2013.01); *G08G 1/0133* (2013.01)

(58) Field of Classification Search
CPC ..... G08G 1/0129; G08G 1/0133; G08G 1/096775; G08G 1/0141; G08G 1/0112
USPC ..... 340/117
See application file for complete search history.

(56) References Cited

U.S. PATENT DOCUMENTS

| | | | | |
|---|---|---|---|---|
| 2013/0033603 | A1 | 2/2013 | Suzuki et al. | |
| 2017/0120803 | A1* | 5/2017 | Kentley | B60W 30/0956 |
| 2017/0120814 | A1* | 5/2017 | Kentley | B60C 5/008 |
| 2017/0167881 | A1* | 6/2017 | Rander | G05D 1/0274 |
| 2018/0136644 | A1* | 5/2018 | Levinson | G01S 17/86 |
| 2018/0158323 | A1 | 6/2018 | Takenaka et al. | |
| 2018/0342165 | A1* | 11/2018 | Sweeney | G08G 1/0133 |
| 2019/0220011 | A1* | 7/2019 | Della Penna | G06V 20/58 |
| 2020/0226920 | A1* | 7/2020 | Takenaka | G08G 1/0133 |

FOREIGN PATENT DOCUMENTS

| | | | | |
|---|---|---|---|---|
| CN | 101533561 | A | * 9/2009 | |
| CN | 103390346 | A | * 11/2013 | |
| CN | 107845264 | A | * 3/2018 | |
| CN | 107945506 | A | * 4/2018 | G08G 1/0116 |
| JP | H064795 | A | * 1/1994 | |
| JP | 5551236 | B2 | 7/2014 | |
| JP | 2017-058773 | A | 3/2017 | |
| JP | 2017-117005 | A | 6/2017 | |
| JP | 2018-010406 | A | 1/2018 | |

* cited by examiner

*Primary Examiner* — Fekadeselassie Girma
(74) *Attorney, Agent, or Firm* — Maschoff Brennan

(57) ABSTRACT

A center device is used in a probe center that collects information from a plurality of vehicles, and functions as an anomaly detector detecting anomaly of travel environment caused on a road. The center device obtains drive data from a vehicle, and determines a probability of anomaly resolution regarding anomaly in a travel environment caused on the road, based on the obtained drive data. The center device, upon determining that anomaly may possibly be resolvable, obtains image data used for a situation determination of an abnormal area, and also obtains a determination result of anomaly resolution based on the image data.

13 Claims, 8 Drawing Sheets

ANOMALY DETECTOR, ANOMALY DETECTION PROGRAM, ANOMALY DETECTION METHOD, ANOMALY DETECTION SYSTEM, AND IN-VEHICLE DEVICE

CROSS REFERENCE TO RELATED APPLICATION

The present application is based on and claims the benefit of priority of Japanese Patent Application No. 2019-005542, filed on Jan. 16, 2019, the disclosure of which is incorporated herein by reference.

TECHNICAL FIELD

The present disclosure according to the specification generally relates to an anomaly detection technique for detecting anomaly in a travel environment of a vehicle occurring on a road.

BACKGROUND INFORMATION

In the related art, there is a travel environment monitor system that includes a vehicle-mounted device and a center device and monitors a travel environment of a vehicle. In the center device, an abnormal location in the travel environment of the vehicle is detected using driving behavior data obtained from the vehicle. The center device then obtains an image or video which includes the abnormal location from the vehicle-mounted (i.e., onboard/in-vehicle) device, and also obtains a result of determination regarding anomaly performed using the image or video (i.e., abnormal contents of the image or video).

The related art, however, is silent about details of how to determine resolution (i.e., disappearance in other words) of a once-detected anomaly in the travel environment.

SUMMARY

It is an object of the present disclosure to provide an anomaly detection device, an anomaly detection program, an anomaly detection method, an anomaly detection system, and an in-vehicle device that can accurately detect a resolution of anomaly in a travel environment of a vehicle while suppressing an increase of load in the center device.

In the present disclosure, before a resolution of anomaly occurring in the travel environment is determined from clue information, a probability of anomaly resolution is determined from the drive data. According to such a selective operation based on the determination regarding a probability of anomaly resolution or "resolvability," an opportunity to determine whether an anomaly is resolved using the clue information is reducible as compared with a case where there is no selective operation based on the determination of probability of resolution of anomaly. As such, it is possible to accurately detect an anomaly resolution in the travel environment while suppressing an increase of the load on the center side (i.e., in the center device). In other words, a qualitative determination in the first place may reduce a computing load (i.e., load involving qualitative determination) otherwise imposed on the center computer.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
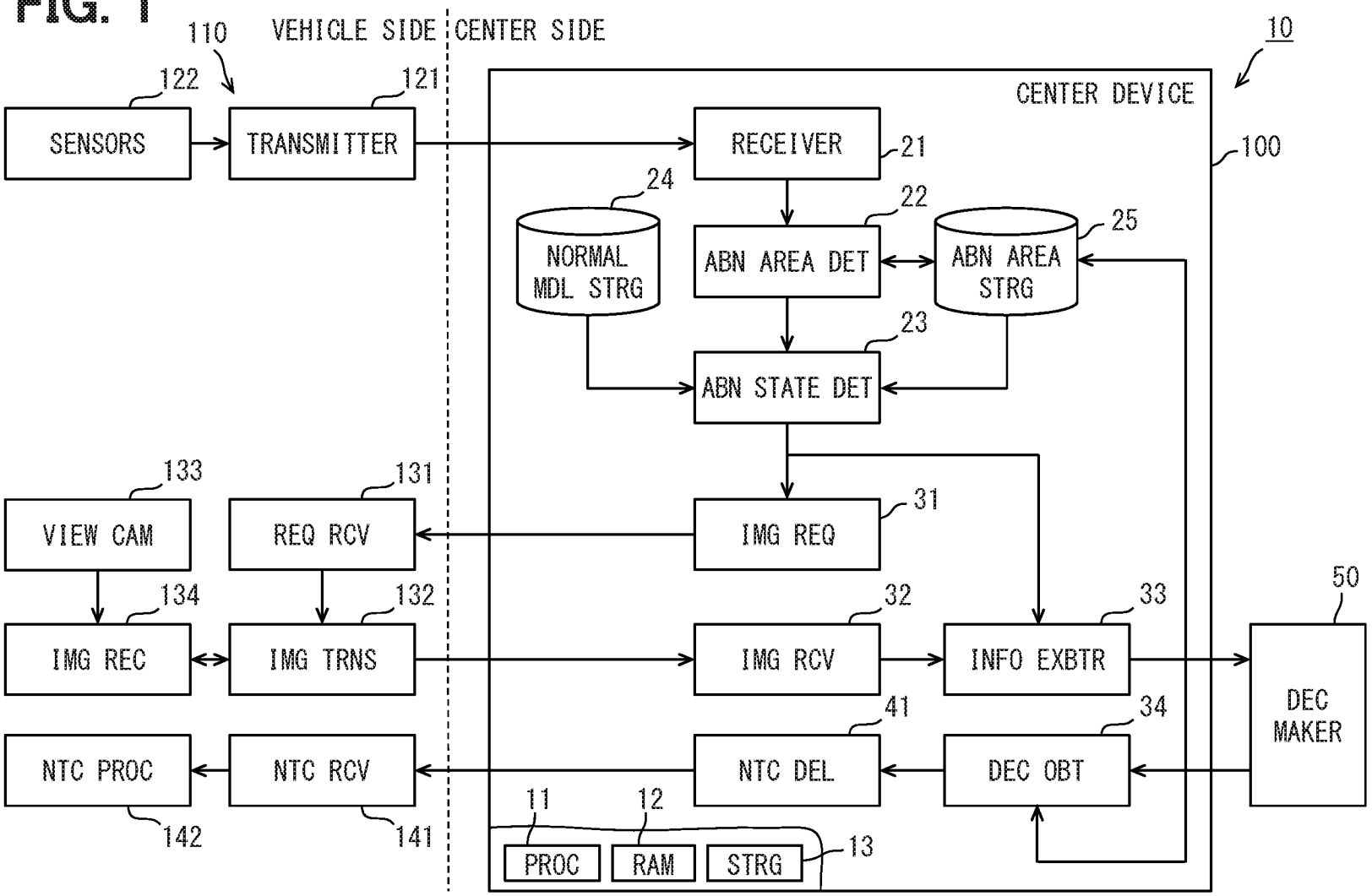
FIG. 1 is a block diagram of an environment monitor system according to a first embodiment of the present disclosure.

Hereinafter, a plurality of embodiments of the present disclosure are described with reference to the drawings. The same reference numerals are assigned to the corresponding elements in each embodiment, and thus, duplicate descriptions may be omitted. When a part of the features in each embodiment is explained, the remaining part of such features may be provided as the features in other prior explained embodiments. Further, not only the combinations of the configurations explicitly shown in the description of the respective embodiments as "wholes," but also the configurations of the plurality of embodiments can be partially combined even when they are not explicitly shown as long as there is no difficulty in the combination in particular. Unspecified combinations of the configurations described in the plurality of embodiments and the modification examples are also considered as disclosed in the following.

First Embodiment

An environment monitor system 10 according to the first embodiment of the present disclosure shown in FIG. 1 collects information provided from a large number of vehicles V, and detects an anomaly in a travel environment that has occurred on a road using the collected information. Anomalies in the travel environment are events that should be notified to each vehicle V, specifically, an occurrence of an accident (e.g., traffic accident), an occurrence of a broken vehicle, an occurrence of an obstacle on the road, and the like. The environment monitor system 10 notifies each vehicle V of the detected anomaly in the travel environment as traffic information. The environment monitor system 10 includes an in-vehicle device 110 mounted on each of a large number of vehicles V, a center device 100 installed in a remote probe center CNT, and the like.

The in-vehicle device 110 is a device that performs a mobile communication according to a 5G communication standard such as an Long Term Evolution (LTE), for example. The in-vehicle device 110 transmits and receives information to and from the center device 100 via a mobile communication base station and a network NW (see FIG. 3). By having the in-vehicle device 110, each vehicle V becomes a connected car that can communicate with the network NW outside the vehicle, and also becomes a probe car that collects probe information about the road.

The in-vehicle device 110 has a direct or indirect electrical connection to in-vehicle components such as an in-vehicle sensor group 122, an image recorder 134, and a notice processor 142 in addition to a GNSS (Global Navigation Satellite System) receiver. A GNSS receiver provides the in-vehicle device 110 with position information of the vehicle V (i.e., position information of a subject vehicle). The GNSS receiver may be a part of an in-vehicle navigation device, or may be a part of a portable terminal that is brought into a occupant compartment of the vehicle V by a occupant.

The in-vehicle sensor group 122 is a group of sensors that respectively detect drive data of the vehicle V (i.e., details are described later). The image recorder 134 is connected to a view camera 133. The view camera 133 is installed in the occupant compartment with an imaging surface facing in a traveling direction (i.e., forward) of the vehicle V (see FIG. 3). The view camera 133 captures, for example, a front range around the vehicle V, and outputs image data of the captured front range to the image recorder 134. The image recorder 134 associates position information and time information to the image/image data input from the view camera 133, and accumulates such data. The notice processor 142 has a configuration such as a display of a navigation device and a speaker of an audio device. The notice processor 142 notifies the occupant of the vehicle V of traffic information distributed from the probe center CNT using display and sound.

The in-vehicle device 110 is mainly configured by a microcontroller including a CPU, a RAM, a ROM, an I/O, a bus line for connecting them, and the like. The CPU is hardware for arithmetic processing combined with the RAM, and can execute a predetermined program. The ROM includes a non-volatile storage medium, and stores a plurality of programs executed by the CPU. The program stored in the ROM at least includes a communication control program for controlling transmission of information to the probe center CNT and reception of information from the probe center CNT. The in-vehicle device 110 includes, i.e., implements, function units such as a data transmitter 121, a request receiver 131, an image transmitter 132, and a notice receiver 141, by executing the communication control program by the CPU.

The data transmitter 121 cooperates with the in-vehicle sensor group 122 to transmit (i) drive operations input to the vehicle V (i.e., input to the subject vehicle) and (ii) measurement data related to a vehicle behavior based on the drive operation to the center device 100 as drive data. The drive data obtained by the data transmitter 121 includes at least one (i.e., preferably plurality) of following items, such as an accelerator opening, a brake pedal force, a steering angle, a vehicle speed, a longitudinal acceleration, a lateral acceleration, and a yaw rate.

The data transmitter 121 continuously obtains drive data from the in-vehicle sensor group 122 during a period in which the vehicle V travels on the road. The data transmitter 121 divides the obtained drive data into pre-defined drive scenes. The data transmitter 121 associates, scene by scene or situation by situation, time and position information (data regarding when and where the drive data is obtained) with the drive data, and transmits the data as group of information to the center device 100.

In response to a request from the center device 100, the request receiver 131 and the image transmitter 132 transmit the image data captured by the view camera 133 to the center device 100. The request receiver 131 receives a provision request specifying a shooting location and shooting time of image data to be transmitted from the center device 100. Based on the provision request received by the request receiver 131, the image transmitter 132 reads image data that matches the shooting location and the shooting time from the image recorder 134. The image transmitter 132 performs conversion processing for reducing the frame rate and resolution of the image data as required, and generates image data for transmission. The image transmitter 132 transmits the image data for transmission to the center device 100 together with the information on the shooting location and the shooting time associated with the image data. Note that the above conversion process for reducing an amount of the communication data may be not necessarily performed. Further, the frame rate and resolution of the image data for transmission may be adjusted as appropriate according to communication environment of the mobile communication.

The notice receiver 141 receives traffic information distributed by the center device 100. The traffic information notified to the notice receiver 141 includes, for example, information indicating an occurrence place and range of anomaly occurring in the travel environment together with information indicating the contents of such anomaly. When the vehicle V is scheduled to travel in an abnormal area TA (see FIG. 3) indicated by the traffic information, the notice receiver 141 cooperates with the notice processor 142 to notify an occupant of such vehicle V of the contents of anomaly indicated by the traffic information prior to the travel of such area, i.e., at a predetermined distance from such area or a predetermined time before reaching the abnormal area TA.

The center device 100 is a computer installed in the probe center CNT. A plurality of center devices 100 may be installed in one probe center CNT. In the probe center CNT, operation data as probe information is collected from a large number of vehicles V traveling in a preset in-charge area. The center device 100 is wired (i.e., connected by wire) to the network NW, and analyzes the drive data collected from each in-vehicle device 110 to monitor occurrence of anomalies such as traffic jams and accidents.

Figure 2:
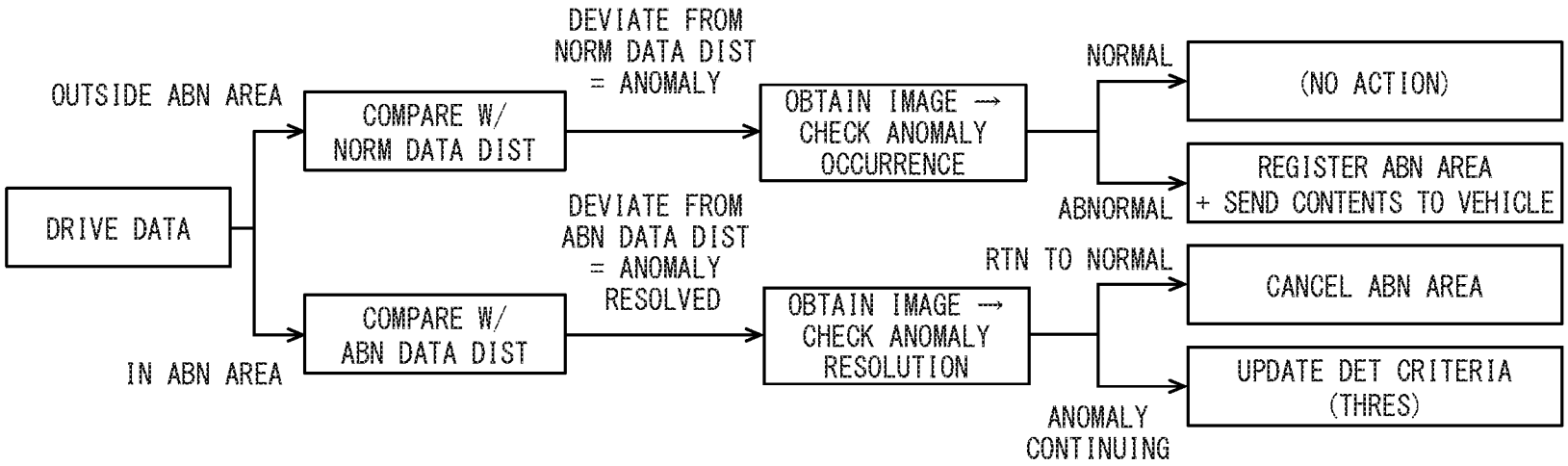
FIG. 2 is a diagram of anomaly occurrence detection and anomaly resolution detection performed by a center device according to the first embodiment of the present disclosure.
Figure 3:
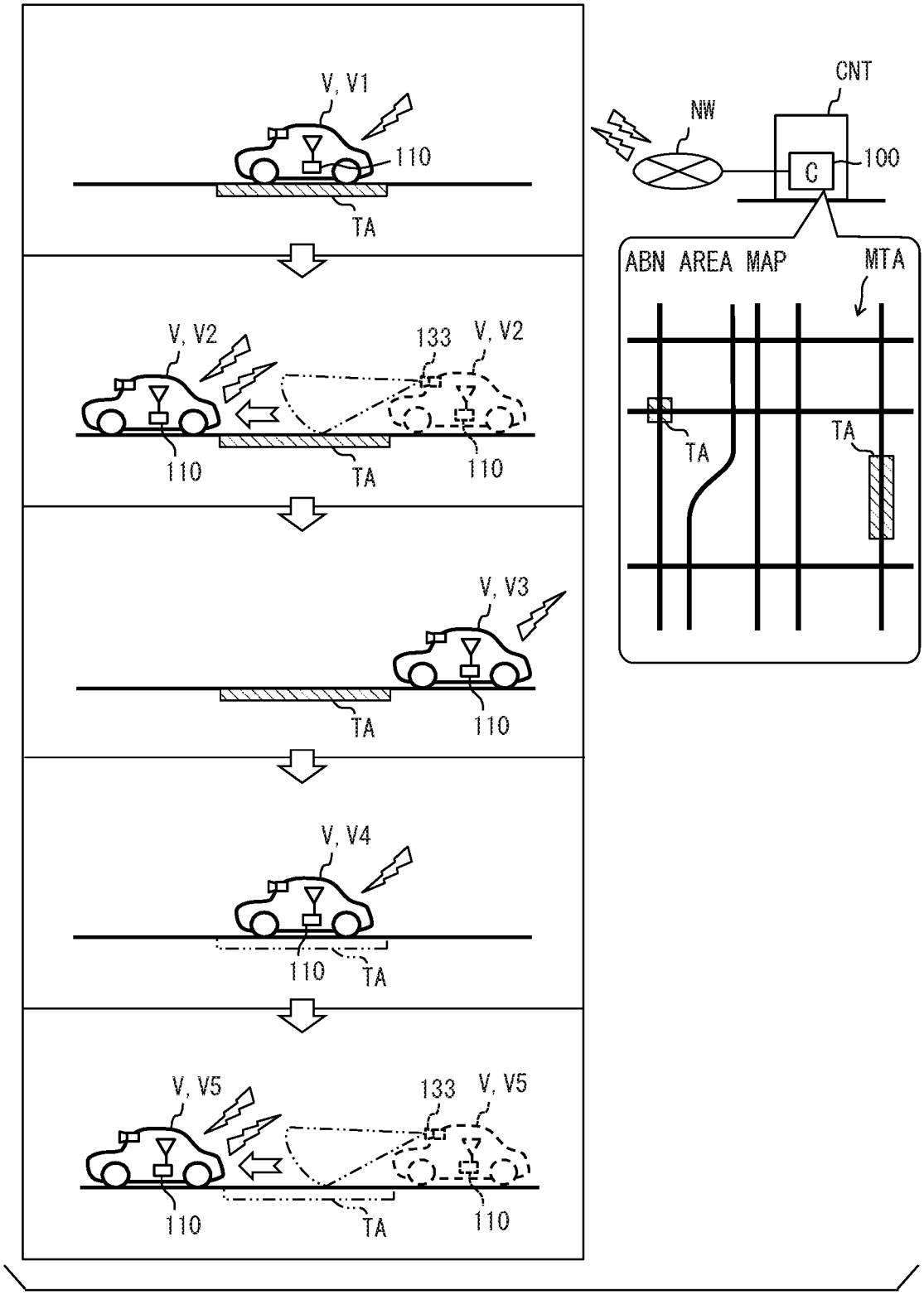
FIG. 3 is a diagram of transition from an occurrence of an abnormal area to a resolution along with an operation of the environment monitor system.

Specifically, when an anomaly occurs in the travel environment on the road, the center device 100 determines a probability of occurrence of anomaly based on the drive data of the vehicle V (see FIG. 3, vehicle V1) traveling in the abnormal area TA as shown in FIGS. 2 and 3. When it is determined that there is a probability of occurrence of an anomaly, the center device 100 obtains image data of the travel environment of the abnormal area TA from a vehicle V (see vehicle V2 in FIG. 3) that has traveled the corresponding abnormal area TA. The image data obtained in such manner is used as clue information (i.e., information used for determination regarding whether anomaly has been occurring or not), and a final determination of anomaly occurrence is performed based on, for example, an anomaly occurrence check by an operator in the probe center or the like.

The center device 100 registers the abnormal area TA in an abnormal area map MTA according to the final determination of anomaly occurrence, and notifies the in-vehicle device 110 of each vehicle of information related to the abnormal area TA as traffic information. Based on the traffic information thus distributed, in the vehicle V scheduled to travel in the abnormal area TA (see vehicle V3 in FIG. 3), information on the abnormal area TA is notified to the occupant.

Furthermore, when the anomaly that has occurred in the travel environment on the road (i.e., may also be referred to as road environment) is resolved, the center device 100 determines a probability of anomaly resolution based on the drive data of the vehicle V (see vehicle V4 in FIG. 3) that travels a place that has been the abnormal area TA. If it is determined that there is a probability of anomaly resolution (i.e., if the anomaly could have possibly be resolved), the center device 100 obtains from a vehicle V that has traveled the abnormal area TA until recently (i.e., immediately before), image data that captures such an environment. The image data obtained in such manner is used as the clue information, and the final determination of anomaly resolution is performed based on, for example, an anomaly resolution check by the operator. The center device 100 then cancels the registration of the abnormal area TA in the abnormal area map MTA based on the final determination of the anomaly resolution, and ends the distribution of the traffic information regarding the relevant area.

In the detection of anomaly, the drive data providing vehicle V1 and the image data providing vehicle V2 may be the same vehicle V or may be different vehicles V. Similarly, in the detection of anomaly resolution, the drive data providing vehicle V4 and the image data providing vehicle V5 may be the same vehicle V or may be different vehicles V. However, the shooting time of the image data obtained as the clue information is approximately the same as or later than the time of obtaining the drive data used for each determination of occurrence and resolution of anomaly, preferably.

As shown in FIG. 1, the center device 100 that performs the above-described anomaly occurrence detection and anomaly resolution detection is a server device mainly composed of a processing circuit including a processing unit 11, a RAM 12, a storage unit 13, an I/O, and a bus line that interconnects them.

The processing unit 11 is hardware for arithmetic processing combined with a RAM, and includes one or a plurality of CPUs (Central Processing Units). In addition to the CPU, the processing unit 11 may include a graphics processing unit (GPU), a field-programmable gate array (FPGA), and an IP core having other dedicated functions. Further, the processing unit 11 may include an arithmetic core specialized in AI (Artificial Intelligence) learning and inference processing or the like.

The storage unit 13 includes various non-transitory, tangible storage media such as a large-capacity hard disk and a flash memory. The storage unit 13 stores at least an anomaly detection program for monitoring occurrence and resolution of anomaly in the travel environment. The execution of the anomaly detection program by the processing unit 11 causes the center device 100 to implement function units, such as a data receiver 21, an abnormal area determiner 22, an abnormal state determiner 23, an image requester 31, an image receiver 32, an information exhibitor 33, a decision obtainer 34, a notice deliverer 41 and the like.

The data receiver 21, the abnormal area determiner 22, and the abnormal state determiner 23 are function units each determine probability of occurrence of anomaly and resolution of anomaly based on the drive data. In order to determine probability of occurrence and resolution of anomaly, a normal model storage 24, an abnormal area storage 25, and the like are provided in the storage unit 13 as storage areas for storing data as determination criteria.

The data receiver 21 sequentially receives drive data transmitted as required from each of the in-vehicle devices 110 respectively mounted on a large number of vehicles V through the network NW.

The abnormal area determiner 22 can refer to the information stored in the abnormal area storage 25. The abnormal area storage 25 stores the abnormal area map MTA (see FIG. 3) indicating a current position and range of the abnormal area TA. As will be described later, the abnormal area TA confirmed as a travel environment anomaly based on the image data is registered in the abnormal area map MTA. The abnormal area TA is erased from the abnormal area map MTA when it is confirmed that a normal state is restored from the abnormal state based on the image data. At such timing, as will be described later, related data of the abnormal area TA is also erased from the abnormal area storage 25.

The abnormal area determiner 22 compares position information associated with drive data obtained by the data receiver 21 with the abnormal area map MTA stored in the abnormal area storage 25. The abnormal area determiner 22 determines whether or not newly obtained drive data (i.e., new data) belongs to the abnormal area TA registered in the abnormal area map MTA. When the new data is obtained in the abnormal area TA, the new data is added to an anomaly model MDa (described later) in the abnormal area storage 25.

The abnormal state determiner 23 can refer to information stored in the normal model storage 24 and the abnormal area storage 25. The normal model storage 24 stores a normal model MDn and a threshold value THa for each of the areas divided in advance (see FIG. 4). The normal model MDn has a content indicating a data distribution in a normal state in which no anomaly occurs in the measurement data of the drive operation or the vehicle behavior included in the drive data. The threshold value THa is a boundary value defined so as to include (i.e., encompass) individual data constituting the normal model MDn. The threshold value THa does not substantially change when there is no change in the road shape or the like.

Figure 4:
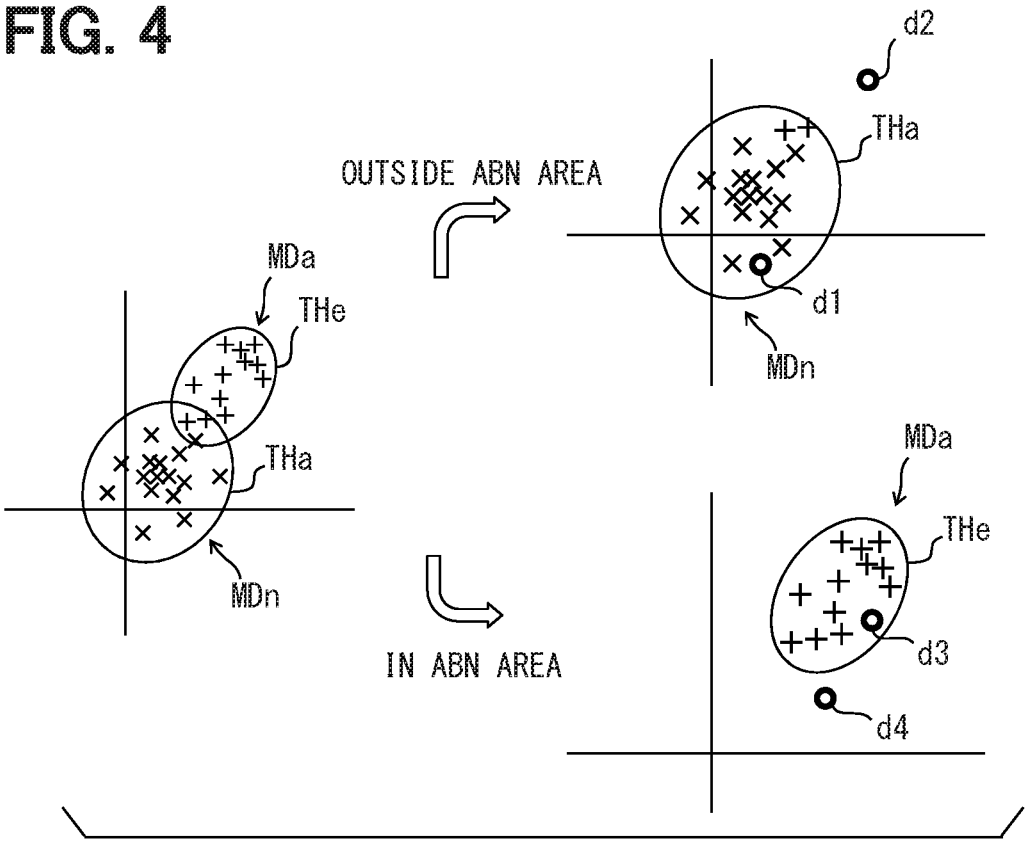
FIG. 4 is a diagram of details of (i) a normal model and a threshold value for determining a probability of anomaly occurrence and (ii) an anomaly model and a threshold value for determining probability of anomaly resolution.

The abnormal area storage 25 stores an anomaly model MDa and a threshold value THe in an abnormal state corresponding to the abnormal area TA (see FIG. 4). The anomaly model MDa has a content indicating a data distribution in a current abnormal state with respect to the measurement data of the drive operation or the vehicle behavior included in the drive data. The anomaly model MDa is an accumulation of a large number of drive data (i.e., accumulated data) accumulated in the anomaly area storage 25 every time an anomaly occurs. The threshold value THe is a boundary value defined to include individual accumulated data constituting the anomaly model MDa. The threshold value THe is a value that changes for each of the abnormalities having occurred, and is a value that can change over time even for the same anomaly.

The abnormal state determiner 23 obtains, from the abnormal area determiner 22, information indicating whether the new data is data obtained outside the abnormal area TA or data obtained within the abnormal area TA. When the new data has already been obtained outside the abnormal area TA, the abnormal state determiner 23 determines a probability of occurrence of anomaly in the travel environment from the new data.

In such a case, the abnormal state determiner 23 reads the normal model MDn and the threshold value THa from the normal model storage 24. The abnormal state determiner 23 compares the data distribution in the normal state indicated by the normal model MDn with the new data (see FIG. 2), and determines a probability of occurrence of anomaly by a process of calculating an anomaly score.

If the anomaly score of the new drive data is less than the threshold THa, that is, when the new drive data does not deviate from the normal state data distribution indicated by the normal model MDn (see d1 in FIG. 4), the abnormal state determiner 23 determines that there is no probability of occurrence of anomaly. On the other hand, when the anomaly score of the new data is equal to or higher than the threshold value THa, i.e., when the new data deviates from the normal state data distribution indicated by the normal model MDn (see d2 in FIG. 4), the abnormal state determiner 23 determines that there is a probability of occurrence of anomaly. In such a case, the abnormal state determiner 23 notifies the image requester 31 and the information exhibitor 33 that there is a probability of occurrence of anomaly.

On the other hand, when the new data has been obtained in the abnormal area TA, the abnormal state determiner 23 determines, from the new data, a probability of resolution of the anomaly occurring in the travel environment. In such a case, the abnormal state determiner 23 reads the anomaly model MDa and the threshold value THe from the abnormal area storage 25. The abnormal state determiner 23 compares the data distribution in the current abnormal state indicated by the anomaly model MDa with the new data (see FIG. 2), and determines a probability of resolution of the anomaly by the process of calculating a resolution score.

If the resolution score of the new data is less than the threshold THe and the new data does not deviate from the current abnormal state data distribution (see d3 in FIG. 4), the abnormal state determiner 23 determines that there is no probability of resolution of the anomaly. On the other hand, if, due to the change of the new data, the resolution score becomes equal to or higher than the threshold value THe and the new data deviates from the current abnormal state data distribution (see d4 in FIG. 4), the abnormal state determiner 23 determines that there is a probability of resolution of the anomaly. In such a case, the abnormal state determiner 23 notifies the image requester 31 and the information exhibitor 33 that there is a probability that the anomaly could have been resolved.

The image requester 31, the image receiver 32, the information exhibitor 33, and the decision obtainer 34 are function units that respectively perform a final determination of anomaly occurrence and anomaly resolution in the travel environment.

The image requester 31 requests, based on a determination of the abnormal state determiner 23 that there is a probability of occurrence of anomaly or there is a probability of anomaly resolution, provision of the image data of the abnormal area TA for the vehicles V2 and V5 in a vicinity of the corresponding abnormal area TA (see FIG. 3). In the provision request by the image requester 31, the shooting location and shooting time of the image data to be transmitted to the center device 100 are specified. The image requester 31 transmits the provision request to at least one in-vehicle device 110.

The image receiver 32 receives the image data returned, i.e., transmitted, from the vehicles V2 and V5 (see FIG. 3) in response to the provision request from the image requester 31. The image data is obtained by the image receiver 32 as clue information for recognizing a current situation of the abnormal area TA. Therefore, it may be desirable that the image data obtained when there is a probability of occurrence of an anomaly has contents that allow confirmation of the occurrence of the anomaly in a normal area. Similarly, it may be desirable that the image data obtained when there is a probability of anomaly resolution has content that allows confirmation of the resolution of the anomaly that has occurred in the abnormal area TA.

The information exhibitor 33 cooperates with a decision maker 50 to make it possible to determine the current state of the abnormal area TA using the image data. Specifically, the information exhibitor 33 outputs the image data obtained by the image receiver 32 to the decision maker 50. The decision maker 50 is a computer connected to the center device 100, and is an operator terminal operated by an operator who monitors the road environment. The decision maker 50 includes a display device that presents image to the operator, and an input unit that receives an input operation of the operator. The image data presented by the information exhibitor 33 is displayed on the display device so that the operator can check the contents by the decision maker 50.

When the decision maker 50 obtains the image data of a normal area where an anomaly may possibly be occurring, a map image showing such a normal area on a map and drive data measured while traveling in such a normal area are obtained are displayed on the display device together with the image data. On the other hand, when obtaining the image data of an abnormal area TA where the anomaly may have already been resolved, the decision maker 50 displays, on the display device, the map image showing the abnormal area TA on the map and the drive data measured when traveling in the abnormal area TA together with the image data.

The operator of the probe center CNT who operates the decision maker 50 visually checks information such as the image data displayed on the display device of the decision maker 50 that is an operator terminal. Thus, the operator recognizes a specific current situation of each area, by using the image data as a main determination material. Then, the operator inputs the confirmation result for the normal area or the abnormal area TA into the input unit of the decision maker 50.

More specifically, as shown in FIGS. 1 and 2, when the image data outside the abnormal area TA is visually confirmed to check for the occurrence of anomaly (reference), the operator inputs, to the decision maker 50, a determination result regarding whether a normal state is occurring (normal, no anomaly) or whether an anomaly is occurring. On the other hand, when the image data in the abnormal area TA is visually confirmed and resolution of the anomaly is checked, the operator inputs, to the decision maker 50, a determination result of whether a normal state is restored by the resolution of the abnormal state or whether the abnormal state is continuing. The continuation of the abnormal state includes a transition of the abnormal states (i.e., from one state to the other). When the abnormal state transitions, in addition to a determination result indicating the occurrence of the abnormal state transition, the operator also inputs a determination result of whether the transition is gradually happening or whether the transition is abruptly happening.

The decision obtainer 34 obtains the determination result determined using the image data from the decision maker 50.

When there is a probability of occurrence of an anomaly, the decision obtainer 34 obtains a determination result indicating either a continuation of the normal state or an occurrence of the anomaly. When the determination result indicating the continuation of the normal state is obtained, the decision obtainer 34 maintains the current state. On the other hand, when the determination result indicating the occurrence of anomaly is obtained, the decision obtainer 34 registers the abnormal area TA in the abnormal area map MTA, and instructs the notice deliverer 41 to deliver the traffic information for the notification of the abnormal area TA.

On the other hand, if there is a probability of anomaly resolution (i.e., the anomaly seems to be resolvable), the decision obtainer 34 obtains a determination result of one of (i) a resolution of the abnormal state (i.e., return to the normal state), (ii) continuation of the abnormal state (i.e., no transition), (iii) continuous transition of the abnormal state, and (iv) abrupt transition of the abnormal state. When a determination result indicating the resolution of the abnormal state is obtained, the decision obtainer 34 cancels the registration of the abnormal area TA in the abnormal area storage 25. As a result, the abnormal area TA is erased from the abnormal area map MTA, and the accumulated data (i.e., the anomaly model MDa and the threshold value THe) associated with the abnormal area TA is also erased from the abnormal area storage 25. In addition, the decision obtainer 34 instructs the notice deliverer 41 to end distribution of the traffic information related to the abnormal area TA whose registration has been canceled.

When a determination result indicating the continuation of the abnormal state is obtained, the decision obtainer 34 uses the process of updating the accumulated data, the anomaly model MDa, and the threshold value THe in the abnormal area storage 25 to update the determination criteria for determining the probability of anomaly resolution. Specifically, when the determination result indicates that the abnormal state continues without transition, the decision obtainer 34 updates the threshold value THe so that new data is included in the corresponding anomaly model MDa. More specifically, as shown in an upper right part of FIG. 5, the threshold value THe is extended to a range including substantially all of the accumulated data of the corresponding anomaly model MDa (see "+") and new data d4.

Here, the transition of the abnormal state may occur gradually or abruptly. For example, when a state transitions in stages, such as occurrence of an accident, succeeded by road closure, on-site processing, to resolution of traffic congestion, a behavior of transition between each of those stages is similar to each other, so the behavior of the vehicle V changes gradually. On the other hand, the behavior of the vehicle V changes abruptly when, for example, there is resolution of road closure, move of an obstacle due to strong wind, collision or the like, a secondary anomaly at a proximity of the vehicle, or the like. In such case, the decision obtainer 34 updates the anomaly model MDa and the threshold value THe in accordance with the transition state of the abnormal state.

Specifically, when the decision obtainer 34 obtains a determination result indicating a transition of an abnormal state in which the vehicle behavior gradually changes, the decision obtainer 34 updates the accumulated data of the corresponding anomaly model MDa while continuing an anomaly flag. As shown in a middle right part of FIG. 5, the decision obtainer 34 deletes data obtained before a predetermined time from (for example, 10 minutes before) the current time. The decision obtainer 34 updates the corresponding anomaly model MDa and the threshold value THe using a part of the accumulated data that is selectively left (see "+" in solid line) and the new data d4.

Figure 5:
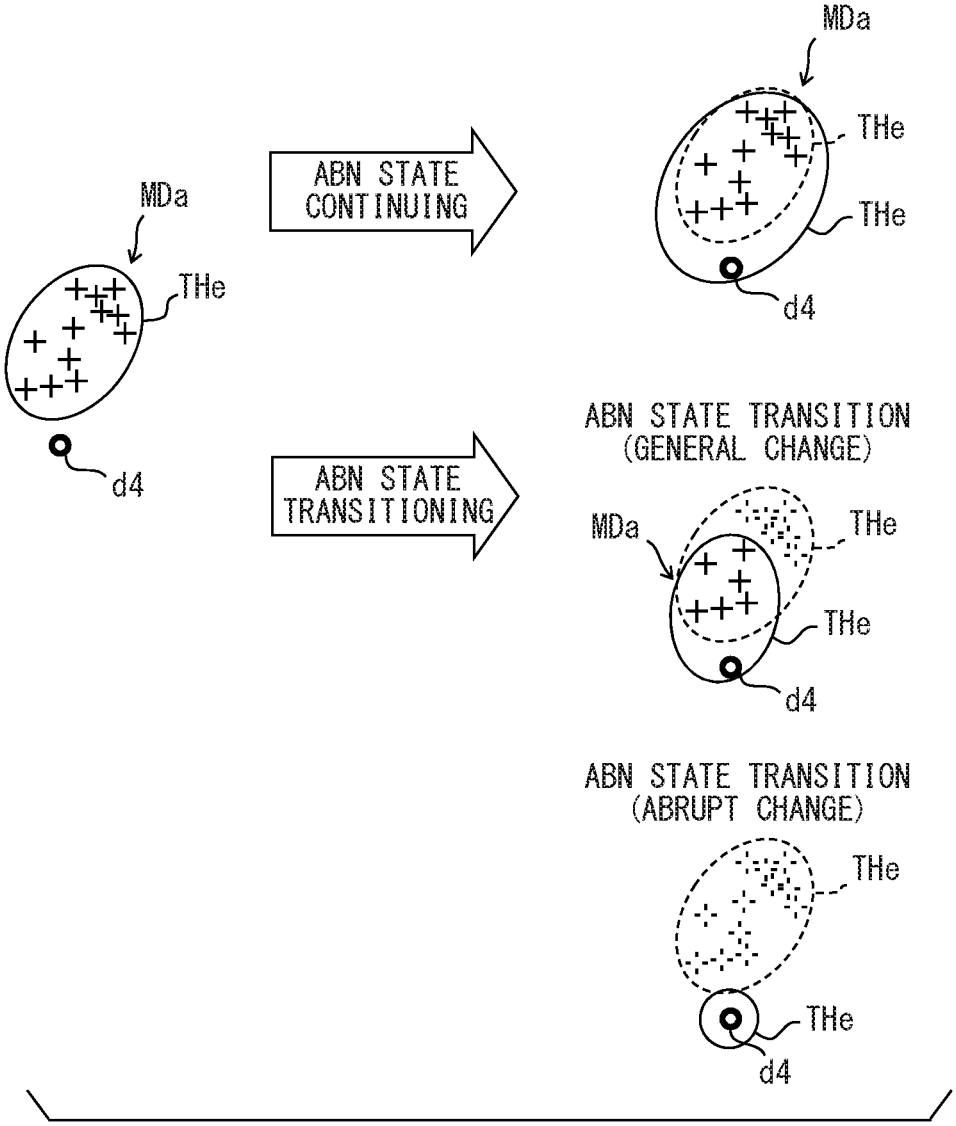
FIG. 5 is a diagram of details of an update method for updating accumulated data based on a determination result, wherein a resolution determination threshold value before update (i.e., pre-update value) is indicated by a broken line, and a resolution determination threshold value after update (i.e., post-update value) is indicated by a solid line.

On the other hand, when the determination result indicating the transition of the abnormal state in which the vehicle behavior changes abruptly is obtained, the decision obtainer 34 deletes substantially all accumulated data (see "+" in broken line) corresponds to the anomaly model MDa while continuing the anomaly flag, as illustrated in a lower right part of FIG. 5. In such manner, the decision obtainer 34 substantially resets the anomaly resolution determination criterion. The decision obtainer 34 resumes the accumulation of the drive data (i.e., the new data d4) after resetting the determination criterion, and sets a new anomaly model MDa and threshold value THe based on the re-accumulated drive data.

Note that the transition of the abnormal state is basically assumed to occur in a mode in which the vehicle behavior gradually changes. Therefore, the decision obtainer 34 is configured to normally update the determination criteria by partially "forgetting" the accumulated data, and, optionally updates the determination criteria by resetting the accumulated data, upon obtaining a determination result indicating an abrupt change.

The notice deliverer 41 is a function unit that distributes traffic information to the in-vehicle device 110 in each of the vehicles V. The notice deliverer 41 transmits the traffic information about a place currently registered in the abnormal area storage 25 as the abnormal area TA to the notice receiver 141 of each in-vehicle device 110. As described above, the notice deliverer 41 can distribute the position and range of the abnormal area TA and the details of contents of the anomaly as the traffic information. The notice deliverer 41 may select a vehicle V that is traveling toward the abnormal area TA for the delivery of the traffic information, or may select a vehicle V that has passed a specific point near the abnormal area TA for the delivery of the traffic information.

As described above, the center device 100, while storing an occurrence point of the travel environment anomaly as the abnormal area TA, (i) detects the occurrence of anomaly outside the abnormal area TA, and (ii) detects the resolution of anomaly within the abnormal area TA. Details of a series of processes, i.e., a probability determination process and a state determination process performed by the center device 100 in order to realize such anomaly detection and anomaly resolution detection of the travel environment, are described based on FIGS. 6 and 7 and with reference to FIGS. 1 to 5.

Figure 6:
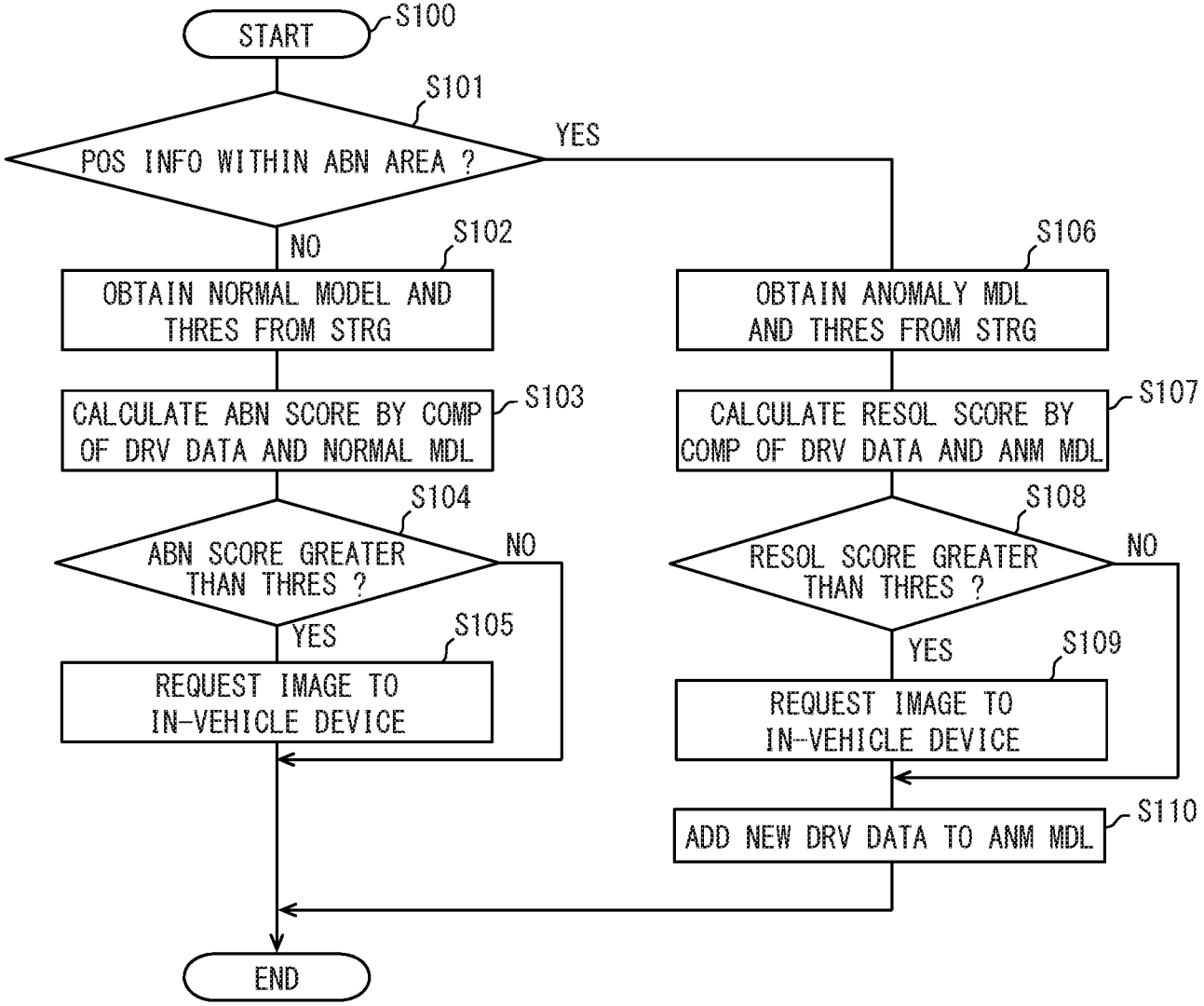
FIG. 6 is a flowchart of details of a probability determination process performed in the center device.

The probability determination process shown in FIG. 6 is started based on obtainment of new drive data from the in-vehicle device 110 (S100). In S101, the position information associated with the drive data obtained in S100 is referred to, and it is determined whether or not the position information is included in the abnormal area TA registered in the abnormal area storage 25. If it is determined in S101 that the position is outside the abnormal area TA, the process proceeds to S102 to S105 for determining the probability of occurrence of an anomaly.

In S102, the normal model MDn and the threshold value THa at the position corresponding to the drive data obtained in S100 are obtained from the normal model storage 24, and the process proceeds to S103. In S103, the drive data is compared with the normal model MDn, an anomaly score is calculated, and the process proceeds to S104. In S104, it is determined whether or not the anomaly score calculated in S103 is equal to or higher than the threshold THa obtained in S102. In S104, when it is determined that the anomaly score is less than the threshold value THa and the drive data does not deviate from the normal model MDn, it is estimated that there is no probability of anomaly occurrence, and the probability determination process ends.

On the other hand, when it is determined that the anomaly score is equal to or higher than the threshold value THa and the drive data deviates from the normal model MDn, it is estimated that there is a probability of anomaly occurrence, and the process proceeds to S105. In S105, a request for provision of image data capturing a measurement position of the current drive data is sent to the in-vehicle device 110 of the specific vehicle (i.e., data providing vehicle) V2, and the probability determination process is ended.

On the other hand, if it is determined in S101 that the position information is within the abnormal area TA, the process proceeds to S106 to S110 for determining the probability of anomaly resolution. In S106, the anomaly model MDa and the threshold value THe at the position corresponding to the drive data obtained in S100 are obtained from the abnormal area storage 25, and the process proceeds to S107. In S107, the drive data and the anomaly model MDa are compared to calculate a resolution score, and the process proceeds to S108.

In S108, it is determined whether or not the resolution score calculated in S107 is equal to or higher than the threshold value THe obtained in S106. In S108, when it is determined that the resolution score is less than the threshold value THe and the drive data does not deviate from the anomaly model MDa, it is estimated that there is no probability of anomaly resolution, and the process proceeds to S110. In S110, new drive data is added to the anomaly model MDa at the corresponding position, and the probability determination process is ended.

On the other hand, when it is determined that the resolution score is equal to or higher than the threshold value THe and the drive data deviates from the anomaly model MDa, it is estimated that there is a probability of anomaly resolution, and the process proceeds to S109. In S109, a request for provision of image data capturing the measurement position of the current drive data is sent to the in-vehicle device 110 of the specific vehicle (i.e., data providing vehicle) V5, and the process proceeds to S110. Also in S110 in such a case, new drive data is added to the anomaly model MDa at the corresponding position, and the probability determination process is ended. Note that, in S110, new drive data may by temporarily stored in a specific storage area, without formally registering the drive data to the anomaly model MDa.

Figure 7:
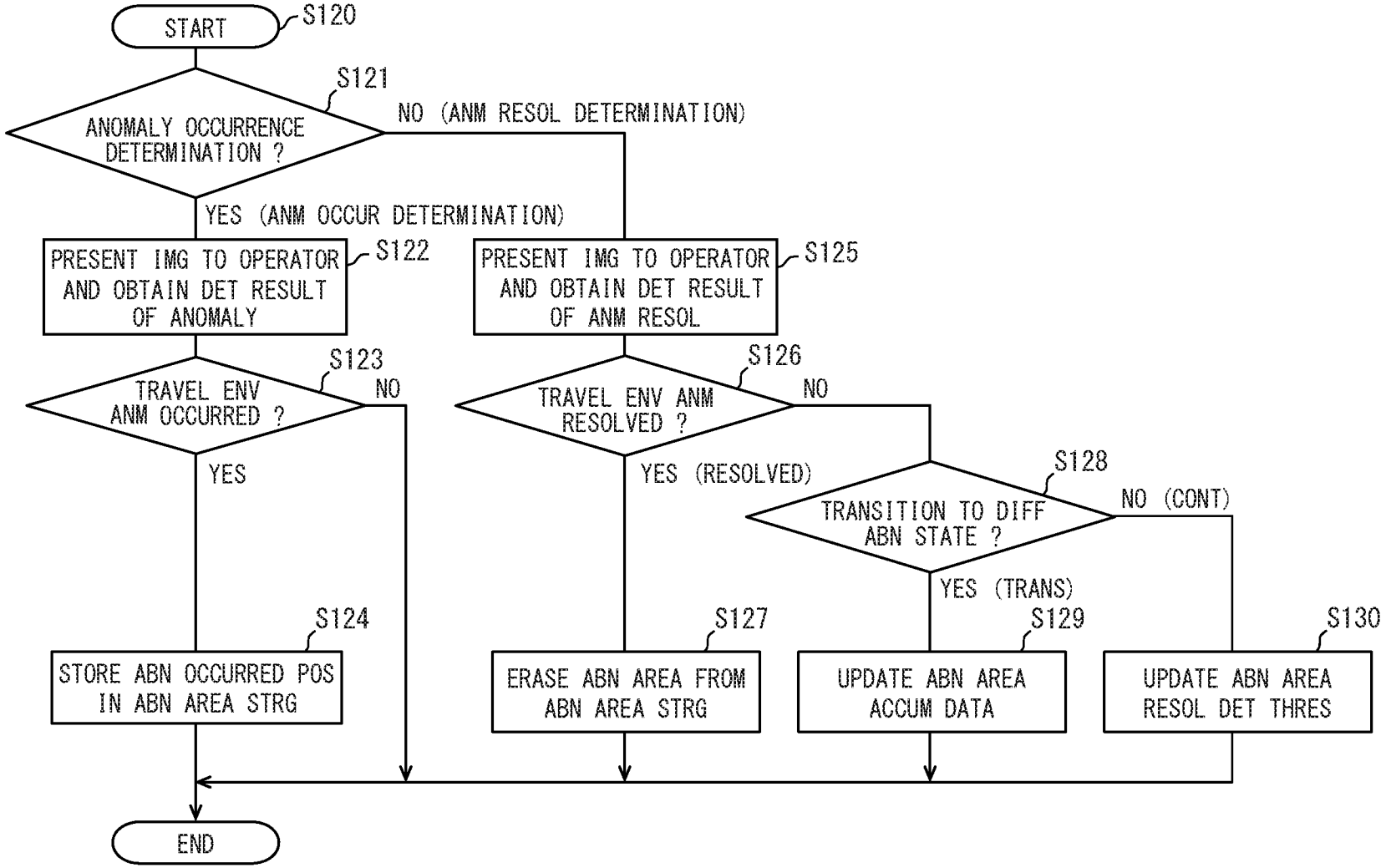
FIG. 7 is a flowchart of details of a state determination process performed in the center device.

The state determination process shown in FIG. 7 is started when the image data is obtained from the target vehicles V2 and V5 based on the request (S105 or S109) in the probability determination process at S120. In S121, it is selectively determined whether a current state determination by using the image data obtained in S120 is about a determination of anomaly occurrence of the travel environment or a determination of anomaly resolution thereof. When it is determined that the current state determination to be performed is an anomaly occurrence determination using the image data, the process proceeds to S122.

In S122, in cooperation with the decision maker 50, the image data capturing the normal area is exhibited to the operator, and the determination result from a determination of whether or not an anomaly has occurred is obtained, and the process proceeds to S123. In S123, with reference to the determination result obtained in S122, when the determination result indicating that the travel environment is normal is obtained, the state determination process is ended.

On the other hand, when the determination result indicating the occurrence of an anomaly in the travel environment is obtained, the process proceeds from S123 to S124. In S124, by performing a process of storing the anomaly occurrence position indicated by the drive data and the image data in the anomaly area storage 25, the abnormal area TA is newly registered to the abnormal area map MTA and the state determination process is ended.

On the other hand, when the determination of anomaly resolution is performed instead of the determination of the anomaly occurrence, the process proceeds from S121 to S125. In S125, in cooperation with the decision maker 50, the image data capturing the abnormal area TA is presented to the operator, and the determination result from a determination of whether or not the anomaly has resolved is obtained, and the process proceeds to S126. In S126, the determination result obtained in S125 is referred to, and if the determination result indicating anomaly resolution has been obtained, the process proceeds to S127.

In S127, the corresponding abnormal area TA is erased from the abnormal area storage 25, and the state determination process is ended.

On the other hand, if the determination result does not indicate that the anomaly has been resolved, the process proceeds from S126 to S128. In S128, it is determined whether or not a transition to a different abnormal state is made based on the determination result. If it is determined in S128 that the state has transitioned to a different abnormal state, the process proceeds to S129. In S129, the accumulated data for the corresponding abnormal area TA is updated, and the state determination process is ended.

Further, if the determination result indicates that the on-going abnormal state is continuing without transitioning to a different abnormal state, the process proceeds from S128 to S130. In S130, by adding new drive data to substantially all of the accumulated data of the corresponding abnormal area TA, the anomaly model MDa and the threshold value THe are updated, and the state determination process is ended.

In the first embodiment described so far in the above, the probability of anomaly resolution is determined from the drive data before the resolution of the anomaly occurring in the travel environment is determined from the image data. According to the selective operation based on the determination of the probability of the anomaly resolution, the opportunity to determine the anomaly resolution using the image data can be reducible as compared with a case where there is no selective operation based on the determination of probability of resolution of anomaly. According to the above, it is possible to accurately detect the resolution of anomaly in the travel environment while suppressing an increase in the load on the probe center CNT side.

In addition, in the first embodiment, the determination criterion for determining the probability of anomaly resolution is updated based on the determination result obtained by the decision obtainer 34. The trend of the drive data indicating resolution of anomaly may be different depending on the contents of occurring anomaly (i.e., anomaly to anomaly). Therefore, in comparison to an assumption that a single data distribution is valid in the normal state, a data distribution in the abnormal state is difficult to assume in advance, due to the various causes of the anomaly.

Therefore, according to the above-described process of sequentially updating the determination criteria for the probability of anomaly resolution, a normal-abnormal determination capacity can further be improvable in the probability determination of anomaly resolution. Therefore, as a result of determination that determines the anomaly resolution by using the image data, the number of cases involving a determination that the abnormal state is continuing without transition decreases. Therefore, an increase in load on the probe center CNT side can be further suppressed.

In the first embodiment, the drive data associated with one abnormal area TA is accumulated in the abnormal area storage 25 for each of abnormalities that has occurred.

Therefore, the data distribution of the drive data in the current abnormal state becomes definable. Then, the abnormal state determiner 23 determines the probability of anomaly resolution by comparing the accumulated data stored in the abnormal area storage 25 with the new data. In other words, the abnormal state determiner 23 can determine that there is a probability of anomaly resolution based on the deviation of the new data from the data distribution of the accumulated data in the current abnormal state. According to the above, determination of the probability of anomaly resolution corresponding to the contents of the anomaly occurring in the abnormal area TA can be performed with high accuracy.

Further, in the first embodiment, when the determination result indicates that the abnormal state is continuing without transition, the determination criterion for the probability of anomaly resolution is updated using substantially all of the accumulated data and new data. (See the upper part of FIG. 5). According to such an update of the determination criteria, the accuracy of determination of the probability of anomaly resolution for the current abnormal state is gradually improved by accumulating the drive data. As a result, unnecessary anomaly resolution determinations are reduced, and an increase in load on the probe center CNT side can be further suppressible.

In addition, in the first embodiment, when the transition of the abnormal state is indicated by the determination result, the decision obtainer 34 updates the determination criteria of the probability of anomaly resolution by using a part of the accumulated data and the new data. In such manner, if the determination criteria are updated by selectively using only a part of the accumulated data and by including the new data, the updated determination criteria have appropriate or preferable contents for a determination of the probability of anomaly resolution regarding the post-transition abnormal state. According to the above, an increase in the load on the probe center CNT side can be further suppressed by improving the determination accuracy of the probability of anomaly resolution.

In addition, the image requester 31 of the first embodiment requests for provision of the image data to the vehicle V based on the determination that the abnormal state determiner 23 has determined that the anomaly may possibly resolvable. In other words, the image requester 31 requests for the image data to the in-vehicle device 110 only when it is substantially determined that there is a probability of anomaly resolution, when it is necessary to perform a determination about anomaly resolution. According to the above, when there is no probability of anomaly resolution, a request for the image data to the center device 100 will not be transmitted, thereby the amount of data communication between the in-vehicle device 110 and the center device 100 can be further reduced.

In the first embodiment, the data receiver 21 corresponds to a "data obtainer," the abnormal state determiner 23 corresponds to a "resolution probability determiner," and the abnormal area storage 25 corresponds to an "abnormal data storage unit." Further, the image requester 31 corresponds to a "clue information requester," the image receiver 32 corresponds to a "clue information obtainer," the decision obtainer 34 corresponds to a "result obtainer," and the center device 100 corresponds to an "anomaly detector" and a "computer." Furthermore, the probe center CNT corresponds to a "center," the abnormal area TA corresponds to an "abnormal location," and the threshold value THe for determination of the resolution of anomaly corresponds to a "determination criterion."

Second Embodiment

Figure 8:
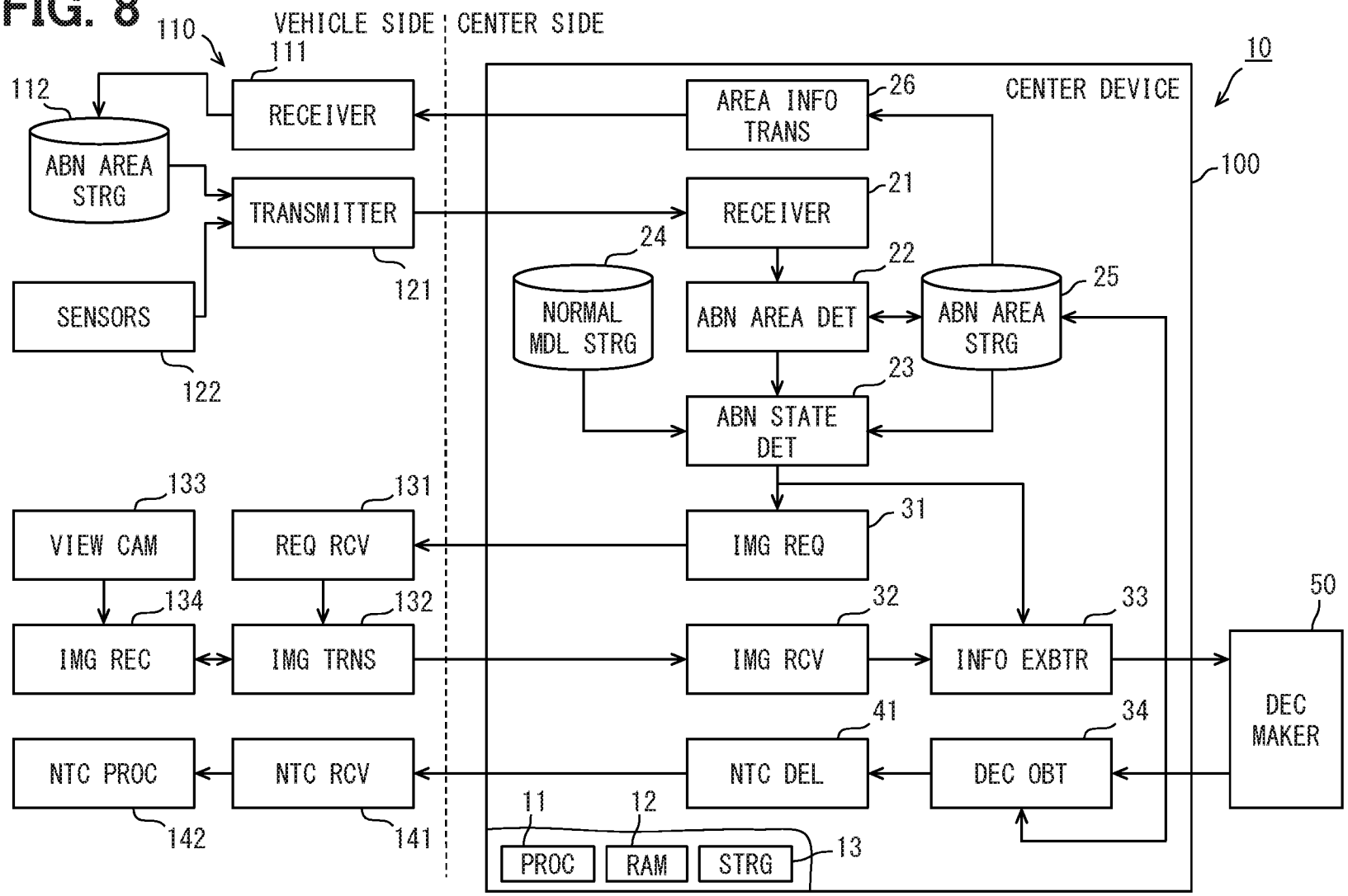
FIG. 8 is a block diagram of the environment monitor system according to a second embodiment of the present disclosure.

The second embodiment of the present disclosure shown in FIG. 8 is a modification of the first embodiment. In the environment monitor system 10 of the second embodiment, a process of selecting the drive data to be transmitted to the center device 100 is performed in the drive data providing vehicle V1 (see FIG. 3). In order to enable such a selecting process, the center device 100 of the second embodiment is further provided with an area information transmitter 26. In addition, the in-vehicle device 110 of the second embodiment is further provided with an area information receiver 111 and an abnormal area storage 112.

The area information transmitter 26 distributes information indicating the position and range of the latest abnormal area TA stored in the abnormal area storage 25 toward each of the in-vehicle devices 110, i.e., to each vehicle V. Information distribution about the abnormal area TA by the area information transmitter 26 is performed at a predetermined time interval or a timing when the abnormal area TA is newly added.

The area information receiver 111 receives information on the position and range of the abnormal area TA distributed by the area information transmitter 26, and stores the information in the abnormal area storage 112. As a result, the abnormal area storage 112 is periodically synchronized with the abnormal area storage 25 of the center device 100. In such manner, the abnormal area storage 112 is in a state where the latest abnormal area map MTA is stored.

The data transmitter 121 compares the position information obtained from the GNSS receiver with the abnormal area map MTA stored in the abnormal area storage 112. The data transmitter 121 determines whether or not the drive data newly measured by the in-vehicle sensor group 122 belongs to the abnormal area TA registered in the abnormal area map MTA. When the position information indicates a position in the abnormal area TA, the data transmitter 121 transmits the drive data input from the in-vehicle sensor group 122 to the probe center CNT as required.

On the other hand, when the position information indicates a position outside the abnormal area TA, the data transmitter 121 determines a probability of occurrence of an anomaly based on the drive data. The probability determination of the occurrence of an anomaly by the data transmitter 121 is performed based on the normal model as in the abnormal state determiner 23 of the center device 100. In such a case, the normal model MDn substantially the same as that stored in the normal model storage 24 is also stored in advance in the ROM of the in-vehicle device 110. However, the threshold value that determines that there is a probability of occurrence of an anomaly is set to have a more relax value than the one used in the abnormal state determiner 23. That is, the data transmitter 121 determines a probability of anomaly more easily than the abnormal state determiner 23. Note that the method of determining the probability of occurrence of anomaly by the data transmitter 121 may be changed as appropriate. As an example, the data transmitter 121 may determine that there is a probability of an anomaly occurrence when a preset vehicle behavior is detected from the drive data.

The data transmitter 121, sequentially or as required, transmits the drive data input from the in-vehicle sensor group 122 toward the probe center CNT based on the determination that there is a probability of occurrence of an anomaly. On the other hand, when it is determined that there is no probability of occurrence of an anomaly, the data transmitter 121 stops transmission of the drive data toward the probe center CNT.

The second embodiment described so far has the same effects as the first embodiment, and the selection based on the probability determination of anomaly resolution using the drive data reduces the chance of determination of anomaly resolution by using the image data. Therefore, it is possible to accurately detect an anomaly in the travel environment while suppressing an increase in the load on the probe center CNT side.

In addition, in the second embodiment, transmission of the drive data to the center device 100 is restricted during a period of traveling outside the abnormal area TA. Therefore, the amount of communication data between the in-vehicle device 110 and the center device 100 can be further reduced. In the second embodiment, the area information receiver 111 corresponds to an "information receiver," and the environment monitor system 10 corresponds to an "anomaly detection system."

Other Embodiments

While embodiments of the present disclosure have been described above, the present disclosure is not limited to these embodiments, and can be modifiable to various other embodiments as well as can be realized as combinations thereof without departing from the scope of the subject matter.

As a first modification of the second embodiment described above, the in-vehicle device 110 may communicate with the center device 100 of the remote probe center CNT, and may transmit information related to an anomaly in the travel environment occurring on the road to the center device 100 ((See FIG. 8). The in-vehicle device 110 includes the area information receiver 111 and the data transmitter 121. In the in-vehicle device 110, the area information receiver 111 receives the position information of the abnormal location where the travel environment is abnormal from the probe center CNT, and the data transmitter 121 transmits the drive data of a vehicle traveling in the abnormal location to the probe center CNT.

In the first modification described above, the center device 100 or the in-vehicle device 110 determines the probability of resolution of the anomaly in the travel environment based on the drive data at the abnormal location. In addition, clue information is further obtainable, which is usable for determining the situation of the abnormal location that has been determined as having the anomaly already resolved is further obtained. According to the first modification as described above, it may also be possible to achieve the same effects as in the above-described embodiments.

As a second modification of the above-described embodiment, the determination result obtained from the decision maker may be reflected to the determination criterion for anomaly resolution detection, and the process of updating the anomaly resolution determination threshold may be omitted. In such a second modification, an anomaly of the vehicle behavior in the drive data may be extracted as a candidate of the travel environment anomaly, and the travel environment anomaly may then formally be determined as anomaly based on the image data, thereby reducing the load on the probe center side similar to the above-described embodiments.

Further, even when the determination criteria used for determining the probability of anomaly resolution are updated, the update method may be changed as appropriate. For example, as a third modification of the above-described embodiment, when a determination result indicating a continuation of the abnormal state is obtained, the determination criterion may be updated to include all of the accumulated data and the new data regardless of whether or not the abnormal state is transitioning.

Further, in a fourth modification, when a determination result indicating transition of an abnormal state is obtained, the determination criterion may be updated to include a part of the accumulated data and the new data regardless of whether the abnormal state transition is slow or rapid. Note that the partial forgetting of the accumulated data accompanying the transition of the abnormal state may be performed on the basis of time as in the above embodiments, or may be performed on the basis of another factor. For example, update of the accumulated data may be performed to always include the drive data obtained from a certain number of vehicles.

In a fifth modification of the above-described embodiment, even when it is determined that there is no probability of anomaly resolution, the image data as clue information may be obtained from the vehicle. For example, the image data for confirming the travel environment of the abnormal area TA may be obtained at regular time intervals as comparative image data for determining whether the anomaly has been resolved. Note that the image data transmitted to the probe center as the clue information may be the image data obtained by capturing left and right views of the vehicle or the image data obtained by capturing a rear view of the vehicle.

As a sixth modification of the above-described embodiment, in addition to the image data, other information for confirming the travel environment may be obtained as the clue information by the center device. For example, point cloud data detected by a LIDAR (Light Detection and Ranging, Laser Imaging Detection and Ranging) device may be provided to the probe center as the clue information. In addition to the image data, the visualized point cloud data image may be displayed on the display device of the decision maker. Further, the recognition result of the travel environment recognized on the vehicle side may be transmitted as the clue information from the in-vehicle device to the center device. In such a case, the amount of communication data can be further reduced.

In a seventh modification of the above embodiment, each of the final determination of occurrence of anomaly and resolution of anomaly based on the clue information may be performed by using a discriminator generated by machine learning. That is, the operator's visual confirmation may be not performed. In such seventh modification, the in-vehicle device can transmit, to the center device, an output data that is derived by performing an extraction process which extracts a feature value from the image data. Further, a recognition result by an external sensor (radar, sonar, etc.) different from the view camera capturing an outside view of the vehicle may be transmitted to the center device as the clue information. Further, the decision maker may be installed in a facility different from the center device.

Further, the final determination by the discriminator and the visual confirmation by the operator may be used in combination. In such a case, the operator's visual confirmation is not performed if the occurrence of an anomaly and the resolution of the anomaly can be confirmed by the final determination by the discriminator, and the visual confirmation by the operator is performed when it cannot be finally determined by the determination by the discriminator. As a result, the number of visual confirmations by the operator is reduced, and the increase in the load on the probe center CNT side can be further suppressed.

As an eighth modification of the above-described embodiment, the center device may be a server device that performs only anomaly resolution detection among anomaly occurrence detection and anomaly resolution detection. In the eight modification, another server device installed in the probe center performs processing for detecting anomaly occurrence, and provides information on the abnormal area TA to the center device.

As a ninth modification of the above-described embodiment, the data receiver, the abnormal area determiner, and the abnormal state determiner may be provided in one of the plurality of center devices, and the image requester, the image receiver, the information exhibitor, the decision obtainer, and the notice deliverer may be provided in the other one of the plurality of center devices. As described above, the plurality of center devices may perform processing related to detection of anomaly resolution in a distributed manner.

In the above embodiment, each of the functions provided by the center device can be provided by software and hardware for executing the software, or by software only, or by hardware only, or by a combination thereof. Further, when such a function is provided by electronic circuitry as hardware, each function can be provided by a digital circuit including a large number of logic circuits or by an analog circuit including the same.

In addition, the form of a storage medium that stores a program or the like that realizes the above-described anomaly detection method may be changed as appropriate. For example, the storage medium is not limited to the configuration provided on the circuit board, but may be provided in the form of a memory card or the like, inserted into a slot portion and electrically connected to a control circuit of the center device. Further, the storage medium may be an optical disk, a hard disk drive, or the like which provides a base of copying the program to the center device.

The vehicle equipped with the in-vehicle device is not limited to a general passenger vehicle, but may be a rental vehicle, a manned taxi vehicle, a ride share vehicle, a freight vehicle, a bus, or the like. Further, the in-vehicle device may be mounted on a vehicle dedicated to unmanned driving used for transportation services. In such a case, vehicle control information generated by an automatic driving ECU is transmitted to the center device as the drive data.

The anomaly detector and the method thereof described in the present disclosure may be realized by a dedicated computer that is configured as having a processor programmed to perform one or a plurality of functions implemented by a computer program. Alternatively, the anomaly detector and the method described in the present disclosure may be implemented by dedicated hardware logic circuits. Alternatively, the anomaly detector and method described in the present disclosure may be implemented by one or more dedicated computers configured as a combination of a processor that executes a computer program and one or more hardware logic circuits. Further, the computer programs may be stored, as instructions executable by a computer, in a tangible non-transitory computer-readable storage medium.

What is claimed is:

1. An anomaly detector for use in an information center that collects information from a plurality of vehicles regarding anomaly of travel environment caused on a road, the anomaly detector comprising:

a data obtainer configured to obtain drive data from the vehicle;

a resolution probability determiner configured to determine a probability of anomaly resolution regarding anomaly of the travel environment based on the drive data before obtaining clue information;

a clue information obtainer configured to obtain the clue information usable for determination of the probability of anomaly resolution about a situation of an abnormal location that has been determined as having a probability of resolution of the anomaly; and a result obtainer configured to obtain a determination result about the determination of the probability of anomaly resolution performed by using the clue information, wherein the result obtainer updates a determination criterion used by the resolution probability determiner for determining the probability of anomaly resolution based on the determination result obtained by the result obtainer.

2. The anomaly detector of claim 1 further comprising:

an anomaly data storage configured to store the drive data associated with the abnormal location as accumulated data, for each of abnormalities having occurred, wherein the resolution probability determiner determines the probability of anomaly resolution based on a comparison between newly obtained drive data and the accumulated data stored in the anomaly data storage.

3. The anomaly detector of claim 2, wherein upon obtaining the determination result indicative of continuation of an abnormal state, the result obtainer updates the determination criterion used for a determination of the probability of anomaly resolution by the resolution probability determiner by using the accumulated data associated with the abnormal location and the newly obtained drive data.

4. The anomaly detector of claim 2, wherein upon obtaining the determination result indicative of transition or change of an abnormal state, the result obtainer updates the determination criterion used for a determination of the probability of anomaly resolution by the resolution probability determiner by using part of the accumulated data and the newly obtained drive data.

5. The anomaly detector of claim 1, further comprising:

a clue information requester configured to request the clue information of the abnormal location to be provided for the vehicle, wherein the clue information requester refrains from requesting the clue information to be provided for the vehicle when the resolution probability determiner determines that there is no probability of anomaly resolution.

6. The anomaly detector of claim 1, wherein the determination criterion is updated as required based on a determination that there is a probability of occurrence of an anomaly.

7. The anomaly detector of claim 1, wherein the result obtainer updates a threshold value used by the resolution probability determiner for determining whether the anomaly is resolved, and the threshold value differs depending on the type of anomaly.

8. An anomaly detection process executed by a computer in an information center that collects information from a plurality of vehicles regarding anomaly of travel environment caused on a road, the anomaly detection process executed by at least one processor in the computer comprising steps of:

obtaining drive data from the vehicle;

determining a probability of anomaly resolution about a resolution of the anomaly of the travel environment based on the drive data before obtaining clue information;

obtaining the clue information usable for determination of the probability of anomaly resolution about a situation of an abnormal location that has been determined as having a probability of resolution of the anomaly; and obtaining a determination result about the determination of the probability of anomaly resolution of the anomaly performed by using the clue information, wherein a determination criterion used for determining the probability of anomaly resolution is updated based on the obtained determination result.

9. An anomaly detection method performed by a computer in an information center that collects information from a plurality of vehicles regarding anomaly of travel environment caused on a road, the anomaly detection method performed by at least one processor in the computer comprising steps of:

obtaining drive data from the vehicle;

determining a probability of anomaly resolution about a resolution of the anomaly of the travel environment based on the drive data before obtaining clue information;

obtaining the clue information usable for determination of the probability of anomaly resolution about a situation of an abnormal location that has been determined as having a probability of resolution of the anomaly; and obtaining a determination result about the determination of the probability of anomaly resolution of the anomaly performed by using the clue information, wherein a determination criterion used for determining the probability of anomaly resolution is updated based on the obtained determination result.

10. An anomaly detection system having an in-vehicle device and a computer in an information center that collects information from the in-vehicle device regarding anomaly of travel environment of a vehicle caused on a road, the anomaly detection system comprising:

in the in-vehicle device an information receiver configured to receive position information of an abnormal location that has anomaly of the travel environment from the information center; and a data transmitter configured to transmit, to the information center, drive data of the vehicle regarding a travel at the abnormal location, and in the computer a resolution probability determiner configured to determine a probability of anomaly resolution regarding anomaly of the travel environment at the abnormal location based on the drive data before obtaining clue information;

a clue information obtainer configured to obtain the clue information usable for determination of the probability of anomaly resolution about a situation of the abnormal location that has been determined as having a probability of anomaly resolution; and a result obtainer configured to obtain a determination result about the determination of the probability of anomaly resolution performed by using the clue information, wherein the result obtainer updates a determination criterion used by the resolution probability determiner for determining the probability of anomaly resolution based on the determination result obtained by the result obtainer.

11. An in-vehicle device in communication with a computer in an information center for transmitting, to the computer, information regarding anomaly of travel environment of a vehicle caused on a road, the in-vehicle device comprising:

an information receiver configured to receive position information of an abnormal location that has anomaly of the travel environment from the information center; and a data transmitter configured to transmit, to the information center, drive data of the vehicle regarding a travel of at the abnormal location, wherein in the computer or in the in-vehicle device a probability about anomaly resolution of the anomaly of the travel environment is determined based on the drive data at the abnormal location before obtaining a clue information usable for determination of the probability of anomaly resolution about a situation of the abnormal location that has been determined as having a probability of anomaly resolution is obtained, and a determination result about the determination of the probability of anomaly resolution performed is obtained by using the clue information, wherein a determination criterion used for determining the probability of anomaly resolution is updated based on the obtained determination result.

12. The anomaly detector of claim 1, wherein the clue information obtainer obtains the clue information using image data.

13. The anomaly detector of claim 12, wherein prior to the resolution probability determiner determining the probability of anomaly resolution based on the drive data, the result obtainer selectively obtains the determination result about the determination of the probability of anomaly resolution by using the clue information that is obtained from the image data.

* * * * *